US009062534B2

(12) United States Patent
Evans et al.

(10) Patent No.: US 9,062,534 B2
(45) Date of Patent: Jun. 23, 2015

(54) PERFORATING SYSTEM COMPRISING AN ENERGETIC MATERIAL

(75) Inventors: Randy L. Evans, Sugar Land, TX (US); Freeman L. Hill, Houston, TX (US); Avigdor Hetz, Houston, TX (US); Jeffrey Honekamp, Tomball, TX (US)

(73) Assignee: Baker Hughes Incorporated, Houston, TX (US)

( * ) Notice: Subject to any disclaimer, the term of this patent is extended or adjusted under 35 U.S.C. 154(b) by 1988 days.

(21) Appl. No.: 11/789,310

(22) Filed: Apr. 24, 2007

(65) Prior Publication Data

US 2008/0034951 A1 Feb. 14, 2008

Related U.S. Application Data

(60) Provisional application No. 60/809,004, filed on May 26, 2006.

(51) Int. Cl.

| | |
|---|---|
| ***F42B 3/08*** | (2006.01) |
| ***F42B 1/02*** | (2006.01) |
| ***E21B 43/117*** | (2006.01) |
| ***E21B 43/116*** | (2006.01) |
| ***F42B 1/032*** | (2006.01) |

(52) U.S. Cl.

CPC ..... *E21B 43/117* (2013.01); *F42B 3/08* (2013.01); *E21B 43/116* (2013.01); *F42B 1/02* (2013.01); *F42B 1/032* (2013.01)

(58) Field of Classification Search

CPC ..... F24B 1/02; F24B 3/08; E21B 43/116; E21B 43/117

USPC ..... 102/306, 307, 308, 309, 310, 476; 149/92; 89/1.15

See application file for complete search history.

(56) References Cited

U.S. PATENT DOCUMENTS

| | | | | |
|---|---|---|---|---|
| 3,235,005 | A | 2/1966 | Delacour | |
| 3,237,559 | A | 3/1966 | Auberlinder | |
| 3,375,108 | A * | 3/1968 | Wyman, Sr. et al. | 419/5 |
| 3,528,864 | A * | 9/1970 | Weinland | 149/92 |
| 3,675,575 | A * | 7/1972 | Bailey et al. | 102/306 |
| 4,498,367 | A * | 2/1985 | Skolnick et al. | 86/1.1 |
| 4,702,171 | A * | 10/1987 | Tal et al. | 102/476 |
| 4,766,813 | A * | 8/1988 | Winter et al. | 102/307 |

(Continued)

FOREIGN PATENT DOCUMENTS

| | | |
|---|---|---|
| DE | 10224503 | 12/2002 |
| DE | 10224503 A1 | 12/2002 |

(Continued)

OTHER PUBLICATIONS

Abstract for German Patent No. 10224503, esp@cenet (1 page).

(Continued)

*Primary Examiner* — James S Bergin

(74) *Attorney, Agent, or Firm* — Bracewell & Giuliani LLP

(57) ABSTRACT

A perforating system, including a shaped charge assembly comprising a charge case, a liner, and a main body of explosive. The material of the perforating system components, including the gun body, the charge case and the liner may be comprised of an energetic material that conflagrates upon detonation of the shaped charge. The material may be an oxidizer, tungsten, cement particles, rubber compounds, compound fibers, KEVLAR®, steel, steel alloys, zinc, and combinations thereof.

3 Claims, 2 Drawing Sheets

(56) References Cited

U.S. PATENT DOCUMENTS

| | | | | |
|---|---|---|---|---|
| 4,798,636 | A * | 1/1989 | Strecker | 149/19.9 |
| 4,958,569 | A * | 9/1990 | Mandigo | 102/476 |
| H000866 | H * | 1/1991 | Faccini et al. | |
| 5,413,048 | A * | 5/1995 | Werner et al. | 102/307 |
| 5,567,906 | A * | 10/1996 | Reese et al. | 102/307 |
| 5,910,638 | A * | 6/1999 | Spencer et al. | 149/18 |
| 6,237,688 | B1 * | 5/2001 | Burleson et al. | 166/281 |
| 6,286,598 | B1 * | 9/2001 | van Petegem et al. | 166/297 |
| 6,393,991 | B1 * | 5/2002 | Funston et al. | 102/476 |
| 6,412,415 | B1 * | 7/2002 | Kothari et al. | 102/313 |
| 6,494,260 | B2 * | 12/2002 | van Petegem et al. | 166/278 |
| 6,668,726 | B2 * | 12/2003 | Lussier | 102/307 |
| 6,983,698 | B1 * | 1/2006 | Walters et al. | 102/307 |
| 6,991,044 | B2 * | 1/2006 | Zhang et al. | 175/4.6 |
| 7,124,820 | B2 * | 10/2006 | Wardlaw | 166/277 |
| 7,159,657 | B2 * | 1/2007 | Ratanasirigulchia et al. | 166/299 |
| 7,393,423 | B2 * | 7/2008 | Liu | 149/38 |
| 7,409,992 | B2 * | 8/2008 | Zazovsky et al. | 166/297 |
| 7,621,332 | B2 * | 11/2009 | Haney et al. | 166/298 |
| 2002/0017214 | A1 * | 2/2002 | Jacoby et al. | 102/307 |
| 2002/0189482 | A1 * | 12/2002 | Kneisl et al. | 102/306 |
| 2003/0037692 | A1 * | 2/2003 | Liu | 102/301 |
| 2005/0011395 | A1 | 1/2005 | Langan et al. | |
| 2005/0211467 | A1 | 9/2005 | Ratanasirigulchia et al. | |
| 2007/0056462 | A1 * | 3/2007 | Bates et al. | 102/476 |
| 2008/0053658 | A1 * | 3/2008 | Wesson et al. | 166/297 |
| 2009/0260821 | A1 * | 10/2009 | Seekford | 166/299 |

FOREIGN PATENT DOCUMENTS

| | | | |
|---|---|---|---|
| EP | 1348683 | | 10/2003 |
| EP | 1348683 | A2 | 10/2003 |
| GB | 2380536 | | 3/2004 |
| GB | 2394762 | | 9/2004 |
| WO | 2005035939 | | 4/2005 |
| WO | 2005035939 | A1 | 4/2005 |

OTHER PUBLICATIONS

International Search Report dated Jun. 20, 2008 (5 pages).

* cited by examiner

PERFORATING SYSTEM COMPRISING AN ENERGETIC MATERIAL

RELATED APPLICATIONS

This application claims priority from co-pending U.S. Provisional Application No. 60/809,004, filed May 26, 2006, the full disclosure of which is hereby incorporated by reference herein.

BACKGROUND OF THE INVENTION

1. Field of the Invention

The invention relates generally to the field of oil and gas production. More specifically, the present invention relates to a shaped charge system and/or gun body. Yet more specifically, the present invention relates to a perforating gun system that after detonation of its associated shaped charges minimizes wellbore gun fragments produced during well perforations. Also the gun system could be designed to disappear upon initiation, doing away with retrieval operations of hardware left downhole.

2. Description of Related Art

Perforating systems are used for the purpose, among others, of making hydraulic communication passages, called perforations, in wellbores drilled through earth formations so that predetermined zones of the earth formations can be hydraulically connected to the wellbore. Perforations are needed because wellbores are typically completed by coaxially inserting a pipe or casing into the wellbore, and the casing is retained in the wellbore by pumping cement into the annular space between the wellbore and the casing. The cemented casing is provided in the wellbore for the specific purpose of hydraulically isolating from each other the various earth formations penetrated by the wellbore. As is known, hydrocarbon bearing strata, such as reservoirs, exist within these formations. The wellbores typically intersect these reservoirs.

Perforating systems typically comprise one or more perforating guns strung together, these strings of guns can sometimes surpass a thousand feet of perforating length. Included with the perforating guns are shaped charges that typically include a charge case, a liner, and a quantity of high explosive inserted between the liner and the charge case. When the high explosive is detonated, the force of the detonation collapses the liner and ejects it from one end of the charge at very high velocity in a pattern called a "jet". The jet penetrates the casing, the cement and a quantity of the formation.

Due to the high force caused by the explosive, the shaped charge and its associated components often shatter into many fragments, some that can exit the perforating gun into the fluids within the wellbore. These fragments can clog as well as damage devices such as chokes and manifolds thereby restricting the flow of fluids through these devices and possibly hampering the amount of hydrocarbons produced from the particular wellbore. Therefore, there exists a need for an apparatus and a method for conducting perforating operations that can significantly reduce fragmentation associated with perforating and thus minimize debris left behind.

BRIEF SUMMARY OF THE INVENTION

A perforating assembly, comprising at least one perforating gun having a shaped charge comprising a charge case, a liner, and a main body of explosive. The components of the perforating gun may be comprised of an energetic material that disintegrates upon detonation of the shaped charge. The individual components include perforating guns (i.e. housing and gun tubes), shaped charges, shaped charge casing, and shaped charge liners. The material may be an oxidizer, tungsten, tungsten alloys, magnesium, magnesium alloys, cement particles, rubber compounds, compound fibers, KEVLAR®, steel, steel alloys, zinc, and combinations thereof.

DETAILED DESCRIPTION OF THE INVENTION

Figure 1:
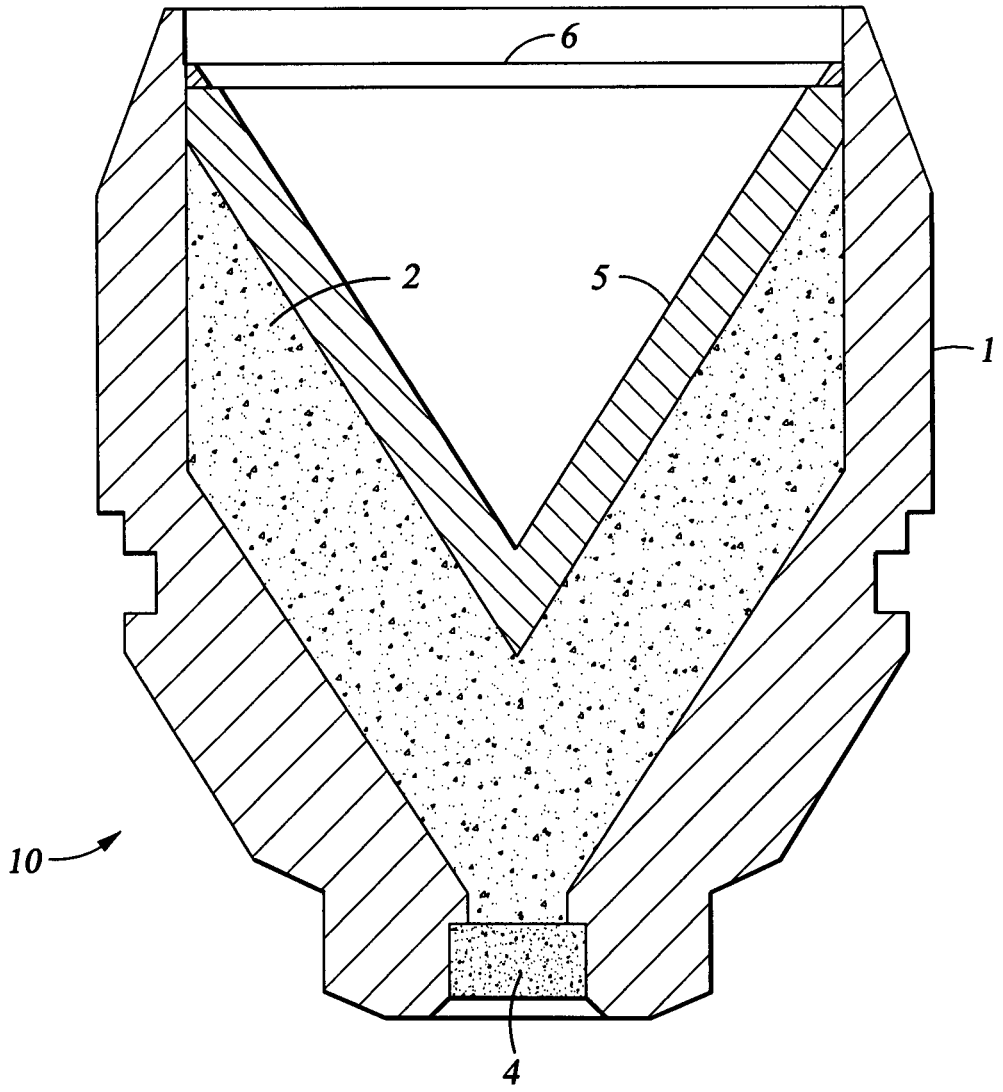
FIG. 1 depicts a perspective cross sectional view of one embodiment of a charge carrier.

With reference to the drawings herein, FIG. 1 depicts a cross sectional view of one embodiment of the present invention in a side aspect. As shown, this embodiment is a shaped charge 10 comprising a charge case 1, a liner 5, explosive 2, an initiator 4, and an optional covering 6. In one embodiment, the material for the charge case 1 and the liner 5 could comprise a reactive energetic material that changes its state from a solid material to a substantially vapor phase composition. The reaction of the energetic material (i.e. its change of state) can be induced subsequent to activation of the shaped charge 10. Initiation of the energetic material reaction may be accomplished by the activation of the shaped charge 10, or by a separate initiating event. It should however occur subsequent to the activation of shaped charge 10. It should be pointed out that the energetic material could have its change of state simultaneous to activation of the shaped charge 10 or at some time after that. The effect of the shaped charge detonation produces temperature and pressure changes that in turn initiate the reactive change of state of the material.

The material may comprise an exothermic reactive material such as an oxidizer or propellant. Examples of such exothermic reactive materials include ammonium perchlorate and potassium perchlorate, among others, as well as combinations of such compounds. The reaction of the material due to the shaped charge detonation effectively vaporizes the energetic material after the shaped charge detonation thereby eliminating the presence of post explosion debris from the components of the shaped charge 10.

Optionally, additives can be included with the energetic material, these include tungsten, magnesium, cement particles, rubber compounds, compound fibers, KEVLAR®, steel, steel alloys, zinc, and combinations thereof. Such additives can desensitize the energetic material to prevent an unplanned reaction of the material. Additionally, desensitizing additives can slow the rate of reaction of the state change of the energetic material thereby reducing localized pressure buildup during vaporization. These additives can also add strength to the energetic material. Desensitizing the material can be especially useful when the final product (i.e. the liner or charge case) is subjected to an environment that might promote early initiation of the material, such as high shock and or vibration, or an event that introduces excess temperature and/or pressure onto the material. Strength of material is important when the energetic material is used to form the shaped charge case 1.

Currently oxidizers are used in the production of subterranean hydrocarbons to create pressure in a hydrocarbon producing wellbore. Such an increase in pressure can be useful for stimulating a hydrocarbon bearing reservoir intersected by the wellbore. These oxidizers are usually in the form of a tube that is exposed to the wellbore and set off with a ballistic action that breaks up the material and bums which creates pressure in the wellbore.

Figure 2:
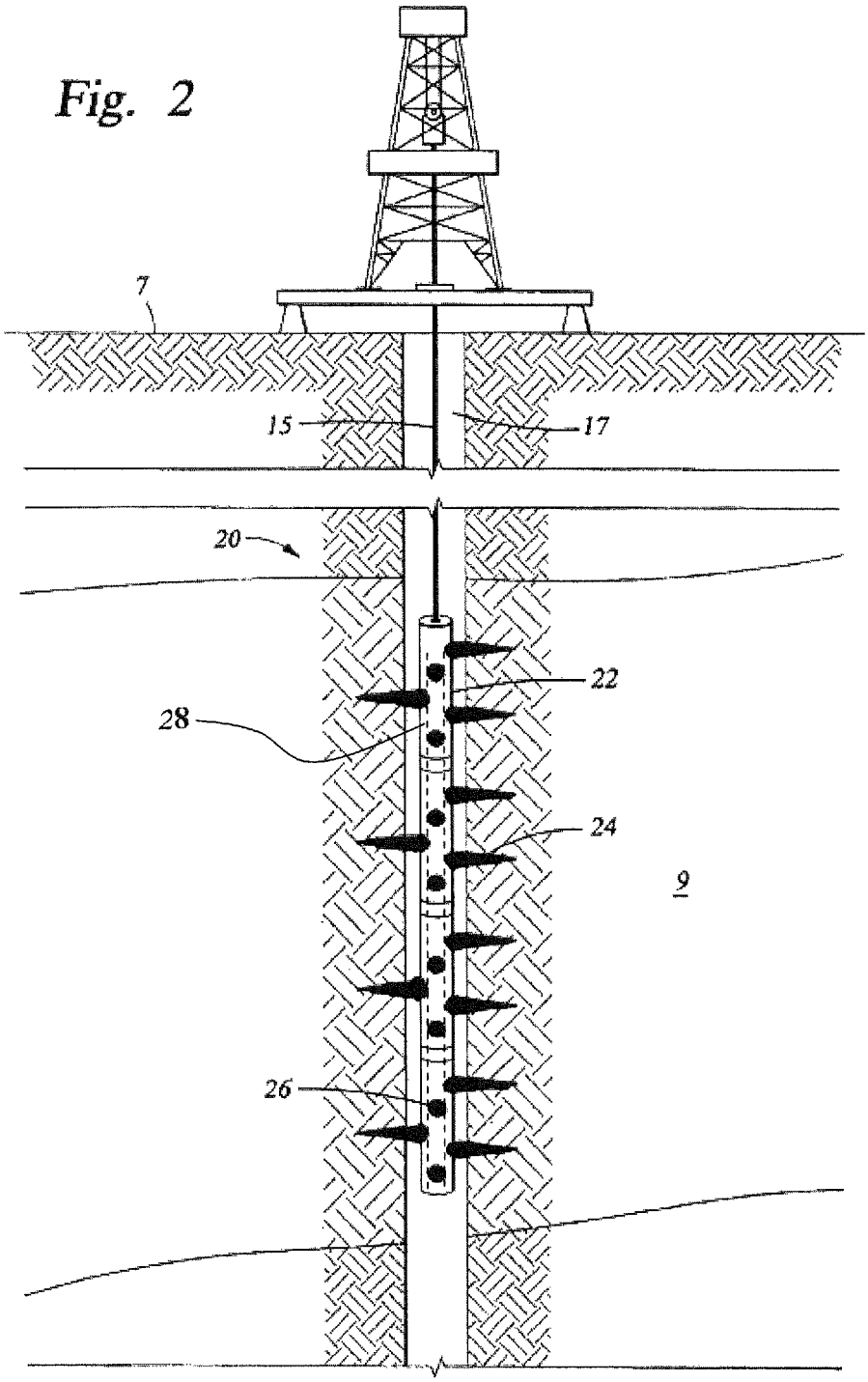
FIG. 2 illustrates a partial cross sectional view of an embodiment of a perforating system.

With reference now to FIG. 2, an additional embodiment of the device herein disclosed is provided. FIG. 2 provides a perforating system 20 disposed by wireline 15 in a wellbore 17, wherein the wellbore 17 intersects a subterranean formation 9. It should be pointed out however that the perforating system 20 is not limited to being disposed on a wireline, it may also be deployed on tubing, such as tubing conveyed perforation, or any other now known or later developed manner of deploying and/or controlling a perforating system. Moreover, the method of operating is not limited to a particular manner, and can include firing under pressure as well as firing heads. As shown, the perforating system 20 comprises individual perforating guns 22 assembled into a gun string. Apertures 26 are formed onto the body of the guns 22 for receiving shaped charges therein, such as the shaped charge of the present disclosure. Detonation of the shaped charges can be initiated from the surface 7 by a signal via the wireline 15 ultimately to the shaped charges. Upon detonation of the shaped charges, jets 24 are formed that extend into the formation 9. In addition to the shaped charge and liner, the other elements of the perforating system 20 may be comprised of the energetic material that changes form subsequent to detonation of the shaped charges. The other elements of the perforating system 20 that may be formed from the energetic material include the gun body, any connection subs that connect adjacent gun bodies, gun tubes 28, and any other material that may comprise a component of a perforating system.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. For example, the invention described herein is applicable to any shaped charge phasing as well as any density of shaped charge. Moreover, the invention can be utilized with any size of perforating gun. It also should be pointed out that the apparatus herein disclosed is not limited to a shaped charge for use with a perforating gun, but can also include any type of ballistics shaped charge—such as those shaped charges used in weaponry and ordinance related technology. These and other similar modifications will readily suggest themselves to those skilled in the art, and are intended to be encompassed within the spirit of the present invention disclosed herein and the scope of the appended claim.

What is claimed is:

1. A perforating system comprising:

a gun body having an annular shape and comprising an energetic material having propellant;

a gun tube in the gun body comprising the energetic material;

an amount of magnesium in the gun body; and a shaped charge disposed in an annulus of the gun body comprising a charge case, a liner, and explosive between the charge case and liner so that when the explosive is detonated, the energetic material and the magnesium in the gun body changes a form of the gun body and the gun tube from a solid material to a substantially vapor phase thereby causing the gun body and the gun tube to disappear after the explosive is detonated.

2. The perforating system of claim 1, wherein the energetic material further comprises tungsten alloys, magnesium alloys, cement particles, rubber compounds, compound fibers, steel, steel alloys, zinc.

3. The perforating system of claim 1, further comprising a connector sub, having energetic material.

* * * * *